US008783186B2

(12) United States Patent
Scanlon et al.

(10) Patent No.: US 8,783,186 B2
(45) Date of Patent: Jul. 22, 2014

(54) USE OF PYROPHORIC PAYLOAD MATERIAL IN AMMUNITION TRAINING ROUNDS

(75) Inventors: John J. Scanlon, Mount Laurel, NJ (US); Rajesh D. Shah, Princeton, NJ (US); John H. Slack, IV, Wallingford, PA (US)

(73) Assignee: Alloy Surfaces Company, Inc., Chester Township, PA (US)

( * ) Notice: Subject to any disclaimer, the term of this patent is extended or adjusted under 35 U.S.C. 154(b) by 0 days.

(21) Appl. No.: 13/276,522

(22) Filed: Oct. 19, 2011

(65) Prior Publication Data

US 2012/0097062 A1 Apr. 26, 2012

Related U.S. Application Data

(60) Provisional application No. 61/394,852, filed on Oct. 20, 2010.

(51) Int. Cl.
*F42B 12/46* (2006.01)

(52) U.S. Cl.
USPC ..... 102/513

(58) Field of Classification Search
USPC ..... 102/334, 346, 444, 498, 499, 502, 513, 102/66, 529, 336; 89/1.61
See application file for complete search history.

(56) References Cited

U.S. PATENT DOCUMENTS

| | | | | |
|---|---|---|---|---|
| 734,966 | A * | 7/1903 | Schou | 102/513 |
| 2,159,999 | A * | 5/1939 | Reichert et al. | 423/268 |
| 3,192,105 | A * | 6/1965 | Wortley, Jr. et al. | 86/1.1 |
| 3,289,589 | A * | 12/1966 | Hitchens et al. | 102/513 |
| 3,291,049 | A * | 12/1966 | Hitchens | 102/513 |
| 3,645,208 | A | 2/1972 | Weinssen et al. | |
| 3,970,003 | A * | 7/1976 | Hayward et al. | 102/336 |
| 4,435,481 | A | 3/1984 | Baldi | |
| 5,578,788 | A * | 11/1996 | Engsbråten | 102/301 |
| 5,585,594 | A * | 12/1996 | Pelham et al. | 102/336 |
| 5,661,257 | A * | 8/1997 | Nielson et al. | 102/334 |
| 6,055,909 | A * | 5/2000 | Sweeny | 102/336 |
| 6,193,814 | B1 * | 2/2001 | Baldi | 148/240 |
| 6,241,994 | B1 * | 6/2001 | Lee et al. | 424/408 |
| 6,497,181 | B1 | 12/2002 | Manole et al. | |
| 6,931,993 | B1 | 8/2005 | Manole et al. | |

(Continued)

FOREIGN PATENT DOCUMENTS

GB 393852 A 6/1933

OTHER PUBLICATIONS

International Search Report and Written Opinion of the International Searching Authority, International Application No. PCT/US2011/056822 filed on Oct. 19, 2011.

*Primary Examiner* — Samir Abdosh
*Assistant Examiner* — John D Cooper
(74) *Attorney, Agent, or Firm* — Novak Druce Connolly Bove + Quigg LLP

(57) ABSTRACT

The present invention relates to munitions employed for training and tactical purposes. Specifically, the present invention relates to training munitions (e.g., training rounds) used with various weapons (e.g., grenade launchers), wherein each training round includes a projectile that contains a pyrophoric payload that is released into the environment and reacts with air, upon impact of the projectile with an impact site. The reaction of the pyrophoric payload with air creates a signal that can be observed from a distance, thereby marking the landing or impact site of the projectile after it has been fired from a weapon.

20 Claims, 1 Drawing Sheet

(56) References Cited

U.S. PATENT DOCUMENTS

| | | | | |
|---|---|---|---|---|
| 6,990,905 | B1 | 1/2006 | Manole et al. | |
| 7,055,438 | B1 | 6/2006 | Manole et al. | |
| 7,475,638 | B2 * | 1/2009 | Haeselich | 102/513 |
| 7,487,728 | B2 | 2/2009 | Cranor | |
| 8,161,883 | B1 * | 4/2012 | Harasts et al. | 102/482 |
| 2008/0053330 | A1 | 3/2008 | Haeselich | |
| 2011/0079164 | A1 | 4/2011 | Broden et al. | |
| 2011/0308420 | A1 | 12/2011 | Mutascio et al. | |

* cited by examiner

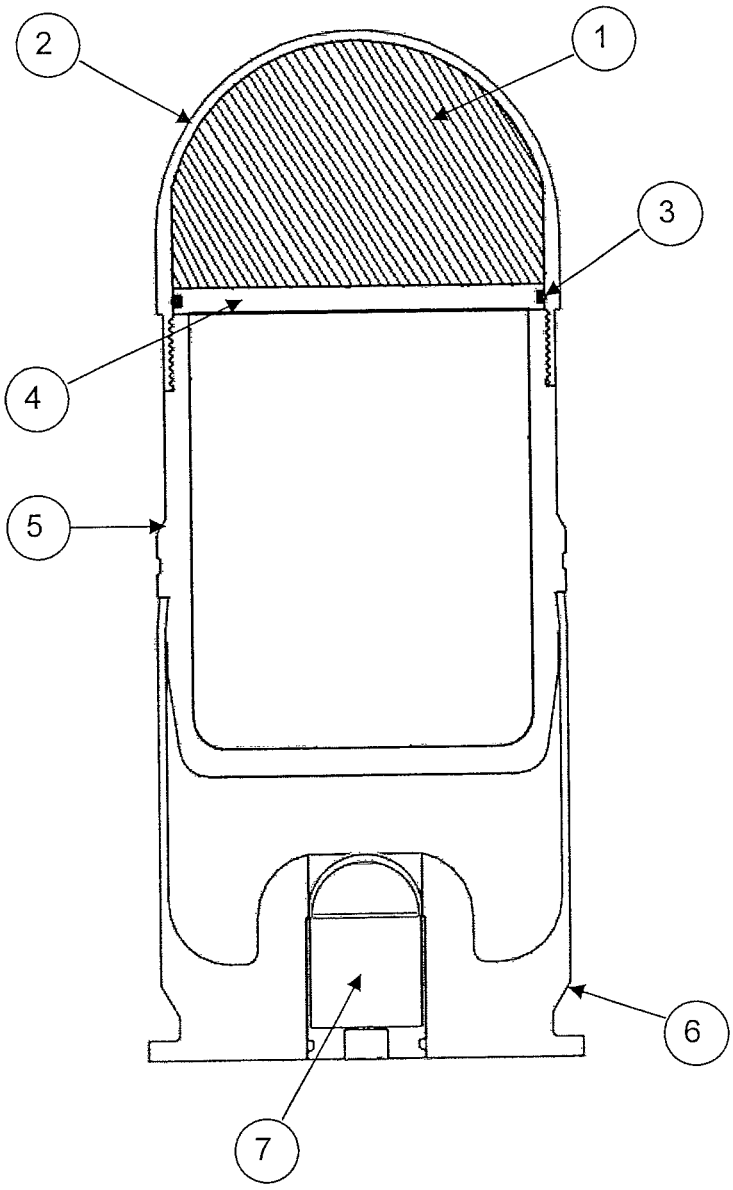
1
2
3
4
5
6
7

USE OF PYROPHORIC PAYLOAD MATERIAL IN AMMUNITION TRAINING ROUNDS

CROSS-REFERENCE TO RELATED APPLICATIONS

This application claims priority to Provisional Patent Application No. 61/394,852, filed in the United States on Oct. 20, 2010, the entire contents of which is incorporated herein by reference.

FIELD OF THE INVENTION

The present invention relates to munitions employed for training and tactical purposes. Specifically, the present invention relates to training munitions (e.g., training rounds) used with various weapons (e.g., grenade launchers), wherein each training round includes a projectile that contains a pyrophoric payload that is released into the environment and reacts with air, upon impact of the projectile with an impact site. The reaction of the pyrophoric payload with air creates a signal that can be observed from a distance, thereby marking the landing or impact site of the projectile after it has been fired from a weapon.

BACKGROUND OF THE INVENTION

In both military and non-military organizations, materials capable of marking the landing or impact site of a projectile after firing from a weapon are commonly employed to assure that the projectile has been delivered to its desired target site.

Indeed, military personnel shoot a variety of weapons and grenade launchers as part of their training. The training is often conducted throughout various military bases and test ranges. During such training, it is particularly important for the users to be able to accurately determine where the fired rounds landed so that adjustments required to hit a target are practiced. In some instances trainees view the impact area with the naked eye. However, training can also include the use of night vision goggles (NVG's), which intensify low light levels, or thermal weapons sights, which detect infrared (IR) signals. Effective training rounds must be capable of marking the landing or impact site of a projectile by creating a signal that can be detected from a distance by an observer during both the day and night, using any of the above methods.

Traditionally, training rounds may contain colored smoke, pyrotechnic compositions or chemiluminescent reaction components to provide signals on impact. While colored smoke can provide a visible signal during the daytime, it is quite difficult to detect at night.

Pyrotechnic compositions can provide signals in the visible region and several IR regions, but have undesirable characteristics when used for training rounds. For instance, in any training scenario, there is some incidence of "dud" rounds which do not function properly on impact. The malfunction of "dud" rounds can be caused in several ways including malfunctioning of the ammunition hardware and of the fuse device. Pyrotechnic training rounds must incorporate a fuse device which ensures that the round will not accidentally detonate if dropped or improperly used. Fuses are typically complex devices with some level of function failure. As a result, pyrotechnic training rounds may not function on impact due to a fuse failure. Any pyrotechnic-containing rounds which do not detonate on impact result in an Unexploded Ordnance (UXO) hazard on the range. Clearing the range of these UXO hazards involves the use of highly trained specialists and consequently, is dangerous and costly.

Moreover, some of the materials incorporated within pyrotechnic training rounds are hazardous and thus pose an environmental concern when utilized. Rainwater leaching of these materials results in pollution of the range soil and groundwater where such training rounds are employed.

Yet another undesirable characteristic of pyrotechnic training rounds is their tendency to start range fires when deployed during dry or arid conditions.

Chemiluminescent rounds utilize materials which emit light when mixed on impact. While they can provide acceptable signatures at night, the light is not bright enough to be clearly visible during the day. In addition, these materials do not emit in the midwave or longwave IR, so they are not visible on thermal weapons sights. Another shortcoming of chemiluminescent rounds is that the duration is relatively long, which can be a problem when training using multiple burst rounds.

DEFINITIONS

Unless defined otherwise, all technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

The term "pyrophoric" as used herein shall refer to materials which spontaneously combust when exposed to air (i.e., they are spontaneously self-actuating in the presence of air to produce heat).

The term "training round" or "training munition" as used herein shall refer to ammunition training rounds of any caliber that contain a projectile that is designed to mark the impact site of the projectile after it has been fired from a weapon.

The term "pyrophoric training round(s)" or "pyrophoric training munition(s)," as used herein shall refer to ammunition rounds of any caliber that contain a projectile that includes a pyrophoric material (i.e., in the form of powder or small foils) that is capable of creating an IR and/or visible signal when the pyrophoric material is released from the projectile upon impact and reacts with air. The IR and/or visible signal must be detectable from a distance of at least 100 feet using either the naked eye or using standard night vision equipment.

The term "anti-clumping agent" refers to a particulate substance that is mixed with the pyrophoric material in the training round and prevents the pyrophoric material from clumping when it is subjected to the compression forces generated when the projectile portion of the training round is fired from the weapon.

The term "infrared," as used herein, shall refer to the full range of infrared radiation and thus includes electromagnetic radiation in the wavelengths from about 0.75 to 1000 microns.

The terms "visible region," "visible signal," and "visible bands," as used herein shall refer to light wavelengths of 0.4-0.74 microns The term "near-IR bands," as used herein shall refer to infrared wavelengths of from 0.75 to 1.4 microns.

The term "mid-wave IR bands," as used herein shall refer to intermediate infrared wavelengths of 3-5 microns.

The term "long-wave IR bands," as used herein shall refer to infrared wavelengths of 8-15 microns.

The term "signal" as used herein shall refer to the flash of visible light and/or burst of infrared radiation that the observer can detect from a distance when the projectile portion of the training round releases the pyrophoric material payload upon impact and the pyrophoric material reacts with air.

The term "clump resistant powder" as used herein, shall refer to a powder that does not visibly compact to form clumps that are visible to the naked eye after exposure to the setback forces that typically result when the projectile portion of a standard training round is fired from a weapon. These setback forces are estimated to be in the range of from 2,000-5,000 lbs force (e.g., equivalent to an acceleration force on a 10 gram mass of about 40,000 to 100,000 g).

SUMMARY OF THE INVENTION

Accordingly, the present invention is directed to training munitions that contain pyrophoric material payloads which substantially overcome one or more of the challenges due to limitations and disadvantages of using the colored smoke, pyrotechnics and chemilumiscent reaction components of the prior art.

Pyrophoric materials oxidize rapidly in the presence of air and can be tailored to provide the required visible and IR signatures. The pyrophoric material is deployed on impact, for example, through the use of frangible hardware components that break open and release or disperse the pyrophoric material into the environment where it reacts with air. The pyrophoric material used in the payloads can be in the form of small foils or fine powder. Pyrophoric foil formulations can be made hot enough to provide daytime visibility with the naked eye, as well as significant IR output. They provide a longer duration option. Typical shapes and sizes for the small foils are: squares with edge length from 0.01 inch to 0.10 inch (preferably from 0.02 inch to 0.08 inch; most preferably from 0.02 inch to 0.06 inch) and circles with a diameter of from 0.01 inch to 0.10 inch (preferably from 0.02 inch to 0.08 inch; most preferably from 0.02 inch to 0.06 inch). The small foils typically have a thickness of from 0.001 to 0.010 inch, preferably of from 0.001 to 0.005 inch. Alternatively, the pyrophoric payloads can be in the form of powder. Pyrophoric powders offer several advantages:

(1) they can provide an extremely bright flash for excellent daytime visibility;

(2) the duration of the signal is short (typically less than a second) so that multiple rounds can be deployed without impact site ambiguity; and (3) there is little payload residue remaining after the round is used (i.e., the powder is dissipated in the air after impact) which minimizes the fire hazard and allows for an eco-friendly payload material.

Typical powder particle sizes for the pyrophoric powders of the present invention are in the range of 1-250 microns, preferably from 5-25 microns, most preferably from 5-15 microns.

By varying the chemical composition of the pyrophoric material in the payload, outputs in the various signature regions can be either strengthened or eliminated. For example, a pyrophoric material can have signatures in the visible, near IR (NIR), midwave IR (MWIR) and longwave IR (LWIR). Alternatively, if it is desired to eliminate the visible signature, the material can be made cooler, so that it only has signatures in the NIR, MWIR, and LWIR. In some cases, it may be desired to provide signatures only in the MWIR and LWIR. This also can be achieved by varying the pyrophoric material composition.

An object of the instant invention is to provide payload materials comprising pyrophoric compositions and a method of using these payload materials wherein the payload materials are capable of producing the visible and/or IR signals required for ammunition training rounds.

A benefit and advantage of the present invention is that the use of the described pyrophoric materials in training rounds can provide excellent signals in one or more of the visible, near IR (NIR), mid-wave IR (MWIR), and long-wave IR (LWIR) bands.

A second benefit and advantage of the present invention is that the described pyrophoric materials are not explosive and therefore pose no UXO hazard. Even in the event of a round which does not function properly on impact, no safety risk exists. Indeed, a "live" round could be stepped on with standard shoes without risk of injury.

Another benefit of the instant invention is that the pyrophoric materials used are environmentally friendly. The described materials contain no hazardous materials and do not contain any residual material that is not present in many soils. Indeed, all of the pyrophoric material is completely oxidized and dispersed when it reacts with air to create the signal upon impact of the projectile fired from the training round.

Yet another benefit of the instant invention is that the pyrophoric materials do not require a fuse device. The lack of a fuse device results in improved reliability and a reduction of the complexity and cost of training rounds.

Another object of the instant invention is to provide a training munition that contains a payload material comprising pyrophoric powder or foil formulations as well as a method of using such payload materials wherein the payload materials are capable of producing the visible and IR signals required in ammunition training rounds.

A benefit and advantage of this invention is that pyrophoric payload formulations can be prepared which provide a signal upon reaction with air that is hot enough to provide daytime visibility with the naked eye, as well as significant IR output. Alternatively, pyrophoric payload formulations can be provided which eliminate the visible signature, if desired. Further, pyrophoric payload formulations can be provided which eliminate both the visible signature and the near-IR (NIR) signature, if desired.

Another benefit and advantage of this invention is that pyrophoric payload powders are capable of providing an extremely bright flash upon impact, thus providing a signal that is clearly visible in daylight. The duration of such flash is short (typically less than one second) allowing the deployment of multiple rounds without landing zone (i.e., impact site) ambiguity.

Another benefit of the present invention, when pyrophoric powders are used, is that no significant payload residue remains after the pyrophoric powders are released from the projectile and react with the air. Indeed, the pyrophoric powder is either completely oxidized, or mostly oxidized, upon exposure to and reaction with the air. Thus, the use of such pyrophoric powders minimizes or eliminates the fire hazards associated with pyrotechnic materials and yields a completely eco-friendly payload material.

In a preferred embodiment of the present invention, the pyrophoric payload powder is a clump resistant powder. The use of a clump resistant powder results in a better signal upon impact (i.e., a signal that is more uniform and intense in both the IR spectrum and the visible spectrum) due to the pyrophoric powder being dispersed into the air as a cloud of fine particles rather than as a mixture of fine particles and clumps or pellets.

In some embodiments of the present invention, the pyrophoric powder itself is clump resistant and needs no special treatment or additives to maintain its clump resistant character.

In other embodiments of the present invention, the pyrophoric powder itself is susceptible to forming clumps under the high inertial or "setback" forces experienced during firing or impact. In these embodiments of the present invention, it is beneficial to add an anti-clumping agent to the pyrophoric powder. When the anti-clumping agent is used in admixture with the pyrophoric payload powder, the resulting signal is more intense in both the IR spectrum and the visible spectrum due to the improved dispersion of the pyrophoric powder into the air upon impact (i.e., in comparison to pyrophoric payload powder that has formed clumps). Further, the mixture of the pyrophoric powder and the anti-clumping agent provides a lower fire risk after impact than powders that contain clumps or compacted portions upon impact. This is due to the fact that the clumps or compacted portions react longer with the air and retain heat longer than the finely dispersed pyrophoric powder.

When selecting an anti-clumping agent, it is important that the agent does not negatively affect the signal to the point where the training round is no longer useful (i.e., the signal is not intense enough in the IR and/or visible spectrums).

It is within the skill of those skilled in the art to determine the optimum amount of anti-clumping agent for a given formulation of pyrophoric powder or pyrophoric powder in association with other additives. It has been found that when an anti-clumping agent is necessary or desirable, typical amounts of anti-clumping agent are from 2 to 50%, preferably from 2 to 20%, by weight of the composition used in the training round (i.e., based on the total weight of the pyrophoric powder payload).

BRIEF DESCRIPTION OF THE DRAWINGS

FIG. 1 is a cross-sectional view of a training round of the present invention.

DETAILED DESCRIPTION OF THE INVENTION

The present invention is directed to a training munition that contains a projectile that includes a pyrophoric payload that is released from the projectile into the environment upon impact of the projectile with an impact site. Upon release from the projectile, the pyrophoric payload material reacts with the air to create a signal (e.g., IR and/or visible) which marks the impact site. The pyrophoric payload materials may be in the form of thin foils or powder. The pyrophoric foils may be made by methods known in the art (e.g., as described in U.S. Pat. Nos. 4,435,481, 4,895,609, 4,957,421, 5,182,078, 6,093,498 and 6,193,814, all of which are incorporated herein by reference). The pyrophoric powders may also be made by several methods, including by separating pyrophoric powder from the aforementioned pyrophorically-activated metal foils. In addition, pyrophoric powders as described in for example, U.S. Pat. No. 4,871,708, the disclosure of which is incorporated herein by reference, can also be utilized in the inventive method described herein.

When pyrophoric powders are used in the training rounds of the present invention, those powders can be made from activated metals such as iron, steel, nickel, tinplate and aluminum. Preferred examples of activated metals from which the pyrophoric powders can be made include Raney iron or Raney nickel, and activated alloys of iron, nickel or copper or of steel compositions. The pyrophoric powders can also be made from activated intermetallics of iron and aluminum or iron, nickel and aluminum or copper and aluminum. The pyrophoric powders can also be made by reducing iron salts (such as oxalate, formate or acetate salts) to pyrophoric iron powder in a reducing atmosphere by techniques that are known in the art. Other known methods for forming pyrophoric powders include the physical grinding of larger particles of aluminum or zirconium to smaller particles (i.e., pyrophoric particles) in the presence of adsorbents that prevent reagglomeration during grinding, and plasma methods for forming small (i.e., small enough to be pyrophoric) metal powder particles. In addition to the pyrophoric powder, the pyrophoric powder payload may contain other powders such as nanoscale metallic or reactive non-metallic powders such as silicon. Additionally, air-reactive organometallic components may be added as oxidation initiators along with non-pyrophoric fine metallic powder components.

The pyrophoric powder used in the present invention should have a number average particle size that is less than 30 microns. It is preferred that at least 90 percent of the particle size range falls within 1-30 microns even when nanoscale powder components are included in the mixture.

As discussed above, the pyrophoric powders that are used in the training rounds of the present invention can be produced by separating the powders from one or more surfaces of pyrophorically-activated metal foils. The pyrophoric powders can be separated from the foils by, for example, scraping, grinding or chopping (e.g., in a blender) the foils and then sifting the powder out from the remains of the metal foil.

Suitable pyrophorically-activated metal foils can be prepared, for example, by depositing aluminum on the surface of an iron-based foil substrate (e.g., iron, steel or tinplate) either alone or as a mixture with other metal powders (e.g., carbonyl iron powder or boron powder) and/or bound with other non-metal powders (e.g., alumina powder or silica powder) to form a coating on the iron-based metal foil. Aluminum can be deposited onto pre-alloyed surfaces using several methods including powder dispersion, foil lamination, or electrolytic deposition techniques. Flame spraying or chemical vapor deposition methods may also be used to apply a chemically leachable alloying component such as aluminum to substrate surfaces. The coated metal foil is then heated under a controlled atmosphere which causes the aluminum to melt and diffuse into the iron-based metal foil to form an iron-aluminide layer on the metal foil. This step is then followed by a removal of at least a portion of the aluminum that is contained in the alloy by selective chemical leaching methods such as dissolution of aluminum in aqueous sodium hydroxide solution followed by washing steps. After the heating and removal processes, the resulting dried metal foil is pyrophorically activated and will self-ignite upon exposure to oxygen. Alternatively, the pyrophorically-activated metallic foils can be prepared in large quantities by the use of the open-coil activating technique described in U.S. Pat. No. 4,871,708, which is incorporated herein by reference.

Another way of forming pyrophorically-activated metal foils that can then be used to prepare pyrophoric powder is to coat a mixture of iron and aluminum powders on the surface of a metal foil (e.g., iron, steel, tinplate or nickel) and then heat the coated foil to a temperature at which the aluminum powder melts but the substrate does not melt. The temperature is only maintained at a level above the melting point of the aluminum powder for a brief time so that the aluminum melts but does not significantly diffuse into the metal foil. The coated foil is then cooled and subjected to leaching (e.g., in aqueous sodium hydroxide solution) to remove some of the aluminum, thus making the surface layer pyrophoric. The pyrophoric surface layer is then separated from the metal foil by, for example, scraping, grinding or chopping the coated foil and then removing the resulting pyrophoric powder from the remaining metal foil (e.g., by sifting through a fine meshed screen).

Using an alternative preparative method, pyrophoric coatings that are suitable precursors for the powders of this invention may be prepared by deposition of aluminum alloy layers onto sacrificial non-metallic substrates without subjecting the substrates to high temperatures. Various rigid organic polymers that retain solubility in organic solvents after polymerization may be used as substrate materials. An example of such a metal alloy deposition method is mixed chemical vapor codeposition of iron and aluminum. After activation by selective leaching of aluminum from the metallic alloy layer, the non-metallic substrate may be chemically dissolved and the residual activated metal crushed under inert atmosphere to a fine powder of appropriate particle size distribution. Alternatively, we contemplate that if appropriate to generation of a particular emission signature, the entire activated film including the organic polymer component could be ground and used in the application of our invention. In this case, combustion or pyrolysis of the polymer component would contribute to the spectral emission.

The pyrophoric powders that are used in the ammunition training rounds of the present invention can also be obtained from commercially available pyrophoric metals such as Raney nickel or Raney iron.

The use of pyrophoric powders in high-velocity ammunition rounds can result in compaction or "clumping" of the payload material due to the high inertial or "setback" forces experienced during firing or impact. Any significant compaction of the pyrophoric powder payload material would result in less intense signals (i.e., less intense in the IR spectrum and visible spectrum) on impact and a greater fire risk, because small clumps of pyrophoric material may burn (or remain at high temperature) for longer periods than the dispersed pyrophoric powder. To alleviate this compaction problem, an anti-clumping agent can be added to the pyrophoric powder, when necessary or desirable. The anti-clumping agent prevents compaction or clumping of the active pyrophoric payload powders during launch and impact and thereby maximizes the signal per volume of payload. When such an anti-clumping agent is used, it is important that the anti-clumping agent does not have a significant deleterious affect on the visible or IR output of the signal produced by the pyrophoric powder upon impact.

Although the full range of infrared radiation encompasses wavelengths from about 0.75 microns to 1000 microns, the region of the infrared radiation spectrum that is usually observed for training rounds is in the 0.75 microns to 20 microns range.

It is also possible to modify the output of the pyrophoric powder payload in the IR spectrum and/or visible spectrum. For example, by adding substances which increase the temperature of the cloud formed when the pyrophoric powder payload reacts with air upon impact, such as nickel or boron powder, the output of the cloud in the IR spectrum is increased (i.e., a hotter output) and the output of the cloud in the visible spectrum is increased (i.e., a brighter output).

In contrast, by adding substances which absorb some of the heat generated by the cloud formed when the pyrophoric powder payload reacts with air upon impact, such as alumina or silica, the output of the cloud in the IR spectrum is decreased (i.e., a cooler output) and the output of the cloud in the visible spectrum is decreased (i.e., a dimmer output).

In a preferred embodiment of the present invention wherein an anti-clumping agent is used, the anti-clumping agent is activated carbon with an average particle size (D50) in the range from 10 to 25 microns, preferably from 12-20 microns, most preferably from 15-20 microns. The activated carbon is typically present in the payload powder in an amount of from 2-20% by weight (i.e., weight percent of activated carbon is based on the total weight of the payload powder, including the activated carbon). Preferred ranges for the activated carbon powder in the payload powder are 2-18%; 4-18% and 10-18% by weight.

Another method of modifying the IR output of the cloud generated when the pyrophoric powder payload reacts with air upon impact is to add an organic powder component to the pyrophoric powder payload. When the pyrophoric powder heats up upon reaction with the air at impact, the organic powder softens, melts or burns to form a residue on a portion of the surface of the pyrophoric metal powder particles, thus restricting the ability of air to contact the surface of the pyrophoric particles thereby preventing the pyrophoric particles from reaching the higher temperature that they would have reached if the organic powder had not been present. By lowering the temperature of the pyrophoric particles, and thereby lowering the overall temperature of the cloud of pyrophoric particles formed upon impact of the training round, the IR output is decreased.

In some embodiments of the present invention, the organic powder also generates a smoke cloud, which can be colored (e.g., red or orange), when it is heated by the reaction between the pyrophoric powder and the air upon impact of the projectile fired from the training round. The smoke cloud creates an additional visible signal which can assist the weapon operator in locating the impact site. An example of an organic powder which forms a smoke cloud having a red color after being heated by the reaction between the pyrophoric powder and air is Disperse Red 9 supplied by Carey Industries Inc. (a substituted anthraquinone dye).

In one embodiment of the present invention, a substance is added to the pyrophoric payload and that substance creates a smoke cloud independent of the heat generated by the reaction of the pyrophoric material with air upon impact. That is, the substance will create a smoke cloud even if the pyrophoric material is not present. An example of such a substance is Blaze Orange® Pigment made by Day-Glo Color Corp. The smoke cloud created by the substance in this embodiment of the present invention may not contain smoke caused by the burning of a substance but instead can be a simple cloud of dispersed particles (i.e., the particles being the powder particles of the substance added to the pyrophoric payload).

In another embodiment of the present invention, at least two chemiluminescent reaction components are added to the pyrophoric payload (i.e., in a separate compartment(s)) to provide visible output independent of the signature outputs of the pyrophoric material.

An example of the training round of the present invention (i.e., the round before firing from the weapon) is shown in cross-section in FIG. 1. The pyrophoric powder payload 1 is contained in the ogive 2 of the round. The body of the round is shown as 5 in FIG. 1. The base of the training round is composed of the cartridge 6, which attaches to the body 5. The propellant charge for the training round is shown as 7 in FIG. 1. The ogive 2 of the training round is frangible and is designed to break open upon impact, thereby releasing the pyrophoric powder payload 1 into the air.

Since the pyrophoric powder reacts rapidly with air, it must be protected from exposure to air at all times before the impact of the projectile that is fired from the training round with the target site. This can be achieved by designing the round so that the body 5 and ogive 2 together form a sealed environment that prevents air from reaching the pyrophoric powder payload in the ogive or by using an ogive which, either by itself or with other components that are not part of body 5, forms a sealed (airtight) environment for the pyrophoric powder payload. Alternatively, the pyrophoric powder payload can be held within a sealed container that is in turn held within the ogive of the training round. For example, the pyrophoric powder payload can be held within a sealed glass container that is disposed within the ogive of the shell. Upon impact, both the ogive and the glass container break open, thereby releasing the pyrophoric powder payload into the environment and exposing the pyrophoric powder to air.

In the training round shown in FIG. 1, the ogive 2 is sealed from the atmosphere before it is attached to the body 5. The ogive 2 is sealed at the bottom through the use of an O-ring 3 and a seal plate 4, which seal the pyrophoric powder payload from contact with the air. The sealed ogive 2 is then screwed onto the body 5.

Although the pyrophoric foil payload and pyrophoric powder payload embodiments of the present invention have been discussed separately herein, it is possible to use payloads that contain both pyrophoric foils and pyrophoric powder.

The foils and powder can be mixed together or they can be held in separate compartments inside the ogive. In addition, the other powders and additives that can be used in conjunction with the pyrophoric powder can also be used in conjunction with the pyrophoric foils or in conjunction with mixtures of the pyrophoric foils and pyrophoric powders.

Although the following embodiments of the present invention are preferred embodiments, they should not be construed as limiting the scope of the present invention, which is defined in the appended claims.

A first preferred embodiment of the present invention is a training munition which contain a projectile that includes a pyrophoric payload contained within frangible hardware, wherein said payload is dispersed into the environment and contacted with air when said projectile impacts an impact site, further wherein said pyrophoric payload marks the impact site by generating signatures (i.e., signals) in at least one electromagnetic radiation wavelength region selected from the group consisting of the visible region, near IR bands, mid-wave IR bands and long-wave IR bands.

A second preferred embodiment of the present invention is a training munition which contains a projectile that includes a pyrophoric payload contained within frangible hardware wherein said payload contains pyrophoric foils or powder and said pyrophoric foils or powder particles are coated or intermixed with at least one organic dye compound such that the heat of said foils or powder after they are dispersed from the projectile at impact and contact air at least partially sublimes (and sometimes completely or nearly completely sublimes) said at least one dye compound, thereby producing smoke at the impact site.

A third preferred embodiment of the present invention is a training munition which contains a projectile that includes a pyrophoric payload contained within frangible hardware, wherein said payload contains pyrophoric foils and said pyrophoric foils are coated or intermixed with at least one organic compound, such that the heat of said foils after they are dispersed from the projectile at impact and contact air, at least partially combusts (and sometimes completely combusts or nearly completely combusts) said organic compounds and augments the signatures in at least one of the various bands of the electromagnetic spectrum (i.e., in at least one electromagnetic radiation wavelength region selected from the group consisting of the visible region, near IR bands, mid-wave IR bands and long-wave IR bands).

A fourth preferred embodiment of the present invention is a training munition which contains a projectile that includes a pyrophoric payload contained within frangible hardware, wherein said payload comprises pyrophoric powder and at least one combustible organic compound (or organic dye compound), such that the heat of said pyrophoric powder after it has been dispersed from the projectile at impact and contacted with air ignites said organic compounds and augments at least one of the signatures in the various bands of the electomagnetic spectrum (i.e., in at least one electromagnetic radiation wavelength region selected from the group consisting of the visible region, near IR bands, mid-wave IR bands and long-wave IR bands).

In several of the preferred embodiments of the present invention, the pyrophoric payload comprises small pyrophoric foils.

In several of the preferred embodiments of the present invention, the pyrophoric payload comprises pyrophoric powder.

In some of the preferred embodiments of the present invention, especially those in which the pyrophoric payload contains pyrophoric powder, the pyrophoric payload comprises pyrophoric powder and an anti-clumping additive.

In some of the preferred embodiments of the present invention, the pyrophoric payload also includes at least two chemiluminescent reaction components which produce visible light at impact. These chemiluminescent reaction components must be kept separate from one another until the projectile is fired from a weapon. Preferably the chemiluminescent reaction components are kept separate from one another until the projectile impacts the impact site. In any event, the chemiluminescent reaction components must be kept separate from the pyrophoric powder, until impact. This separation can be achieved by keeping the various components in separate compartments with separation barriers that remain intact until either the projectile is fired from a weapon or until the projectile impacts the impact site.

In some of the preferred embodiments of the present invention, the pyrophoric payload also includes a dye material which produces smoke at impact and at least two chemilumiscent reaction components which produce visible light at impact. Although the dye material can be mixed with the pyrophoric powder, the chemiluminescent reaction components must be kept separate from one another until after the projectile is fired from a weapon (preferably separate until impact). The chemiluminescent reaction components must also be kept separate from the pyrophoric powder and dye material, until impact.

Example 1

A training munition (i.e., an ammunition training round) containing a pyrophoric payload, such as that shown in FIG. 1, can be prepared by following the steps described in the present example. The pyrophoric powder that is discussed in the example can be commercially available pyrophoric powder (such as Raney nickel or Raney iron) or can be pyrophoric powder that is obtained by separating (for example by scraping, chopping or grinding) active pyrophoric powder from a substrate.

In a glove box under a nitrogen atmosphere, the pyrophoric powder is sieved (if necessary) to obtain the desired particle size (e.g., powder that passes through a 100-mesh screen). This pyrophoric powder is then mixed with an anti-clumping agent (if necessary) and/or any other additives that are desired (e.g., organic compounds to create smoke, metal powders, reactive non-metallic powders, etc.) to create the pyrophoric payload material, shown as 1 in FIG. 1. The pyrophoric payload material is then placed in the frangible ogive 2 of the training round by, for example, pouring the pyrophoric payload material into the ogive while the open end of the ogive is facing upwards. The ogive 2 can be sitting in a tared fixture on a balance so that the amount of pyrophoric material being added to the ogive can be accurately weighed. While the ogive is still in a position with its open end facing upwards, a seal plug or plate 4 is inserted into the open end of the ogive. The seal plate has an o-ring 3 on the end that is inserted into the open end of the ogive so that the o-ring forms an air-tight seal with the inner surface of the ogive. Once the seal plate is in place, the sealed ogive is removed from the glove box and tested for leaks. If the sealed ogive passes the leak test, it is attached to the body 5 of the training round and secured to the body, for example by screw threads that enable the sealed ogive to be screwed onto the upper end of the body. Once the sealed ogive and body are attached together, a cartridge 6 is attached to the lower end of the body, for example by crimping. A propellant charge 7 is then inserted into the bottom of the cartridge to complete the training round.

In use, the projectile that is fired from a weapon will include all of the parts of the training round shown in FIG. 1 except for the cartridge 6 and the propellant charge 7.

What is claimed is:

1. A training munition which contains a projectile that includes a pyrophoric payload contained within frangible hardware, wherein said frangible hardware breaks open when said projectile impacts an impact site, thereby releasing the pyrophoric payload into the environment where said pyrophoric payload contacts air, further wherein said pyrophoric payload comprises pyrophoric powder, small pyrophoric foils or mixtures of pyrophoric powder and small pyrophoric foils and marks the impact site by generating signatures in at least one electromagnetic radiation wavelength region selected from the group consisting of the visible region, near IR bands, mid-wave IR bands and long-wave IR bands, further wherein said projectile contains no explosive material and said pyrophoric payload further comprises activated carbon powder as an anti-clumping additive.

2. The training munition of claim 1 wherein said pyrophoric payload comprises pyrophoric foils.

3. The training munition of claim 2 wherein said pyrophoric foils are coated with organic dye compound, and said pyrophoric payload also produces smoke upon impact of said projectile with said impact site.

4. The training munition of claim 2 wherein said pyrophoric foils are coated or intermixed with at least one organic compound that at least partially combusts or sublimes upon exposure to the heat generated by said pyrophoric payload after it is dispersed from said projectile upon impact and contacts air.

5. The training munition of claim 1 wherein said pyrophoric payload comprises pyrophoric powder.

6. The training munition of claim 5 wherein said activated carbon is present in an amount of from 2 to 20% by weight of the pyrophoric payload.

7. The training munition of claim 5 wherein said pyrophoric payload further comprises at least one dye material which also produces smoke at said impact site after said pyrophoric payload is dispersed into the environment.

8. The training munition of claim 5 wherein said pyrophoric payload comprises at least one organic compound that at least partially combusts upon exposure to the heat generated by said pyrophoric payload after it is dispersed from said projectile.

9. The training munition of claim 1 wherein in addition to said pyrophoric payload said munition also includes at least two chemiluminescent reaction components which mix together after the projectile is fired from a weapon and which produce visible light at the impact site after impact.

10. The training munition of claim 9, wherein said pyrophoric payload also includes at least one dye material which produces smoke at said impact site after said pyrophoric payload is dispersed into the environment.

11. The training munition of claim 9, wherein said at least two chemiluminescent reaction components are held in a compartment that is separate from the pyrophoric payload, further wherein said at least two chemiluminescent reaction components are held in said compartment separate from one another until after the projectile is fired from a weapon.

12. The training munition of claim 11, wherein said at least two chemiluminescent reaction components are held in said compartment separate from one another until impact of the projectile with said impact site.

13. The training munition of claim 1 wherein said pyrophoric payload also includes at least one dye material which produces smoke at said impact site after said pyrophoric payload is dispersed into the environment.

14. The training munition of claim 1, wherein said pyrophoric payload comprises pyrophoric powder and an amount of at least one organic compound, further wherein, after impact, when the pyrophoric powder heats up upon exposure to air, at least a portion of said amount of organic compound at least partially softens, melts or burns to form a residue on a portion of the surface of the pyrophoric powder.

15. The training munition of claim 1, wherein said pyrophoric payload comprises small pyrophoric foils and an amount of at least one organic compound, further wherein, after impact, when the small pyrophoric foils heat up upon exposure to air, at least a portion of said amount of organic compound at least partially softens, melts or burns to form a residue on a portion of the surface of the small pyrophoric foils.

16. The training munition of claim 1, wherein said pyrophoric payload comprises a mixture of small pyrophoric foils and pyrophoric powder and an amount of at least one organic compound, further wherein, after impact, when the small pyrophoric foils and pyrophoric powder heat up upon exposure to air, at least a portion of said amount of organic compound at least partially softens, melts or burns to form a residue on a portion of the surface of the small pyrophoric foils and pyrophoric powder.

17. A training munition which contains a projectile that includes a pyrophoric payload contained within frangible hardware, wherein said payload is dispersed into the environment and contacted with air when said projectile impacts an impact site, further wherein said pyrophoric payload comprises pyrophoric powder and from 2 to 50% by weight of activated carbon powder as an anti-clumping additive and marks the impact site by generating signatures in at least one electromagnetic radiation wavelength region selected from the group consisting of the visible region, near IR bands, mid-wave IR bands and long-wave IR bands and said projectile contains no explosive material.

18. The training munition of claim 17, wherein said pyrophoric payload comprises pyrophoric powder and from 2 to 20% by weight of activated carbon powder as the anti-clumping additive.

19. The training munition of claim 17, wherein said pyrophoric payload comprises pyrophoric powder and from 10 to 18% by weight of activated carbon powder as the anti-clumping additive.

20. A training munition which contains a projectile that includes a pyrophoric payload contained within frangible hardware, wherein said frangible hardware breaks open when said projectile impacts an impact site, thereby releasing the pyrophoric payload into the environment where said pyrophoric payload contacts air and marks the impact site by generating signatures in at least one electromagnetic radiation wavelength region selected from the group consisting of the visible region, near IR bands, mid-wave IR bands and long-wave IR bands, further wherein said pyrophoric payload comprises pyrophoric powder and from 2 to 20% by weight of activated carbon powder as an anti-clumping additive and said projectile contains no explosive material.

* * * * *